US007654097B2

(12) United States Patent
Hawkes

(10) Patent No.: US 7,654,097 B2
(45) Date of Patent: Feb. 2, 2010

(54) ICE DISTRIBUTION DEVICE FOR AN ICE RETAINING UNIT WITH OPTIONAL SENSOR CONTROL THEREFOR

(75) Inventor: Richard B. Hawkes, Bethlehem, PA (US)

(73) Assignee: Follett Corporation, Easton, PA (US)

( * ) Notice: Subject to any disclaimer, the term of this patent is extended or adjusted under 35 U.S.C. 154(b) by 348 days.

(21) Appl. No.: 11/749,209

(22) Filed: May 16, 2007

(65) Prior Publication Data

US 2008/0282721 A1 Nov. 20, 2008

(51) Int. Cl.
*F25C 5/18* (2006.01)

(52) U.S. Cl. ..... 62/137; 62/344; 222/516; 222/519; 239/251; 414/301

(58) Field of Classification Search ..... 62/137, 62/344; 222/516, 519, 520; 239/251, 261, 239/380–382, 587.5; 414/301
See application file for complete search history.

(56) References Cited

U.S. PATENT DOCUMENTS

| | | | | |
|---|---|---|---|---|
| 3,126,719 | A | 3/1964 | Swatsick | |
| 3,371,505 | A | 3/1968 | Raver et al. | |
| 3,581,768 | A | 6/1971 | Conti | |
| 3,771,560 | A | 11/1973 | Conti et al. | |
| 3,791,592 | A * | 2/1974 | Cobb | 239/666 |
| 3,877,241 | A * | 4/1975 | Wade | 62/137 |
| 3,880,300 | A * | 4/1975 | Uhl | 422/219 |
| 4,055,280 | A | 10/1977 | Kohl et al. | |
| 5,060,484 | A * | 10/1991 | Bush et al. | 62/137 |
| 5,211,030 | A | 5/1993 | Jameson | |
| 5,542,573 | A | 8/1996 | Frantz | |
| 5,657,782 | A * | 8/1997 | Berning | 134/167 R |
| 5,799,777 | A * | 9/1998 | Mailliet et al. | 198/642 |
| 5,887,758 | A | 3/1999 | Hawkes et al. | |
| 5,971,690 | A * | 10/1999 | Whitten | 414/301 |
| 6,134,908 | A | 10/2000 | Brunner et al. | |
| 6,443,193 | B1 * | 9/2002 | Blasco | 141/286 |
| 6,685,053 | B2 | 2/2004 | Hawkes et al. | |
| 6,860,408 | B2 | 3/2005 | Hawkes | |
| 6,952,935 | B2 | 10/2005 | Vorosmarti et al. | |
| 7,096,686 | B2 | 8/2006 | Brunner et al. | |
| 7,137,271 | B2 | 11/2006 | Hawkes et al. | |

* cited by examiner

*Primary Examiner*—William E Tapolcai
(74) *Attorney, Agent, or Firm*—Paul & Paul

(57) ABSTRACT

An ice distribution device for delivering ice to an ice retaining unit is provided, whereby a nozzle of the distribution device is adapted to be rotated in an eccentric rotation when installed at an upper end of an ice retaining unit, such that, when it is rotated about its axis, forces acting inside an eccentrically mounted nozzle will produce both axial and lateral components, with the lateral components of force providing a controlled "wobble", that will deliver a substantially uniform distribution of ice within the retaining unit. A sensing device, which may be ultrasonic, mechanical or some other means, may be used to sense the level of build-up of ice within a retaining unit, for discontinuing the flow of ice to the distribution device, or diverting it to another ice retaining unit, as may be desired. The distribution and sensing devices are mounted on a top wall of the ice retaining unit and are adapted to accommodate top walls of such units of various thicknesses.

16 Claims, 4 Drawing Sheets

Prior Art FIG. 1

ICE DISTRIBUTION DEVICE FOR AN ICE RETAINING UNIT WITH OPTIONAL SENSOR CONTROL THEREFOR

BACKGROUND OF THE INVENTION

In the manufacture of apparatus for manufacturing, delivering, and storing ice, it has been known that ice can be manufactured from various mechanisms, including, but not limited to an auger-type ice maker involving a freezing chamber with an auger therein, a compacting head where ice is formed from shavings that are compacted, with the ice delivered to a retaining device for use by periodic discharge, for example, as needed. The ice shavings can be made from a water source whereby water is delivered to the chamber to be scraped therefrom, and with a refrigerant system comprising means for cooling the water delivered to the chamber, such refrigerant system including a compressor, condenser, and an expansion valve.

The refrigerant system can, for example, be constructed as disclosed in U.S. Pat. Nos. 3,126,719; 3,371,505 or 6,134,908, or in any other manner.

Ice thus formed can be delivered to an ice retaining means, such as an apparatus for storing and dispensing ice as is disclosed in U.S. Pat. No. 5,211,030, or a storage bin such as is disclosed in U.S. Pat. No. 6,685,053, as is disclosed in an ice access and discharge system such as U.S. Pat. No. 5,887,758, or as disclosed in U.S. Pat. No. 6,952,935.

It has been commonplace that, when filling large ice storage or retaining units, the ice enters at a single point, as discrete ice particles, and drops from the point of entry, downward, into the ice retaining means. Such delivery of ice into a retaining means generally results in an inverted cone-shaped pile of ice having its apex located directly under the point of entry, not resulting in an even distribution of ice across the bin or other ice retaining means.

THE PRESENT INVENTION

The present invention is addressed to a more uniform and complete distribution of ice across the ice retaining unit, bin or the like.

The present invention also optionally senses the level of accumulated ice in the bin or other retaining unit and, as the same reaches a desired predetermined level, activates a valve or other mechanism that interrupts the delivery of ice to the ice retaining bin or unit, either shutting down the ice delivery system, or diverting the ice to an alternative ice retaining unit.

The sensing device can be an ultrasonic sensing device, an infrared beam type sensing device, a mechanical system that is triggered at a certain level of ice in the ice retaining unit, or the like.

The distribution of ice into the retaining unit is effected by delivery of ice to a nozzle that is angularly disposed relative to the ice that is delivered thereto, to eccentrically rotate a nozzle as the result of the forces of ice on the nozzle which produces a partial lateral force, as well as an axial force thereon, such partial lateral force causing the eccentric rotation which effects the more uniform distribution of ice throughout the ice retaining unit.

SUMMARY OF INVENTION

The present invention is directed to an ice distribution device for delivering ice to an ice retaining unit, with the device including a delivery conduit for delivering ice to the ice distribution device in an axial direction, some means for mounting the ice distribution device relative to the ice retaining unit, a nozzle for receiving ice delivered from the ice delivery conduit and for discharging ice through the nozzle into an ice retaining unit, with the nozzle being mounted at an angle to an axial direction of delivery of ice to the ice distribution device, with the nozzle also be mounted for axial rotation, such that the force of ice being delivered from the ice delivery conduit and through the nozzle applies a sufficient partially lateral force to the nozzle to drive the nozzle in an eccentric rotation, such that ice that is distributed through the nozzle can be dispersed in a fan-like array that has both axial and lateral components, for providing a substantially uniform distribution of ice in an ice retaining unit.

Accordingly, it is an object of this invention to provide an ice distribution device as set forth in the summary of invention above.

It is a further object of this invention that the nozzle that is mounted for axial rotation includes an anti-friction bearing device.

It is another object of this invention to include, in an ice retaining unit, a sensor for sensing the level of buildup of ice and for activating a means for interrupting the further delivery of ice to the ice distribution device.

It is yet another object of this invention to accomplish the above object, where the sensor is an ultrasonic sensor or a mechanical sensor or some other type of sensor.

It is a further object of this invention to accomplish the above objects, such that when the flow of ice is interrupted to the conduit, it can either shut down the delivery of ice, or divert the delivery of ice to an additional ice retaining unit.

Other objects and advantages of the present invention will be readily understood by a reading of the following brief descriptions of the drawing figures, the detailed descriptions of the preferred embodiments, and the appended claims.

BRIEF DESCRIPTIONS OF THE DRAWING FIGURES

FIG. 1 is a schematic illustration of a prior art method of making ice from shavings inside an auger, by means of a refrigerant that freezes water in a chamber throughout a conventional refrigeration cycle, and wherein an auger produces shavings that are compressed into ice nuggets for delivery to an ice retaining means, and wherein the delivery to an ice retaining means produces an inverted cone-like accumulation of ice therein.

FIG. 2 is a somewhat enlarged, schematic illustration, in two fragmentary parts, of portions of the ice retaining means illustrated in FIG. 1, but wherein, in accordance with this invention, the ice distribution device is mounted at an upper end thereof, for a more uniform distribution of ice within the retaining unit, than that illustrated in the prior art illustration of FIG. 1, and wherein a sensor device is mounted at the upper end thereof, for ultrasonically sensing the buildup level of ice within the retaining unit, or for optionally mechanically sensing such buildup, and, in either case, for then activating a controller unit for controlling a valve which can optionally either shut off delivery of ice to the ice delivery conduit, or divert the same to an additional ice retaining unit, as may be desired.

DETAILED DESCRIPTIONS OF THE PREFERRED EMBODIMENTS

Figure 1:
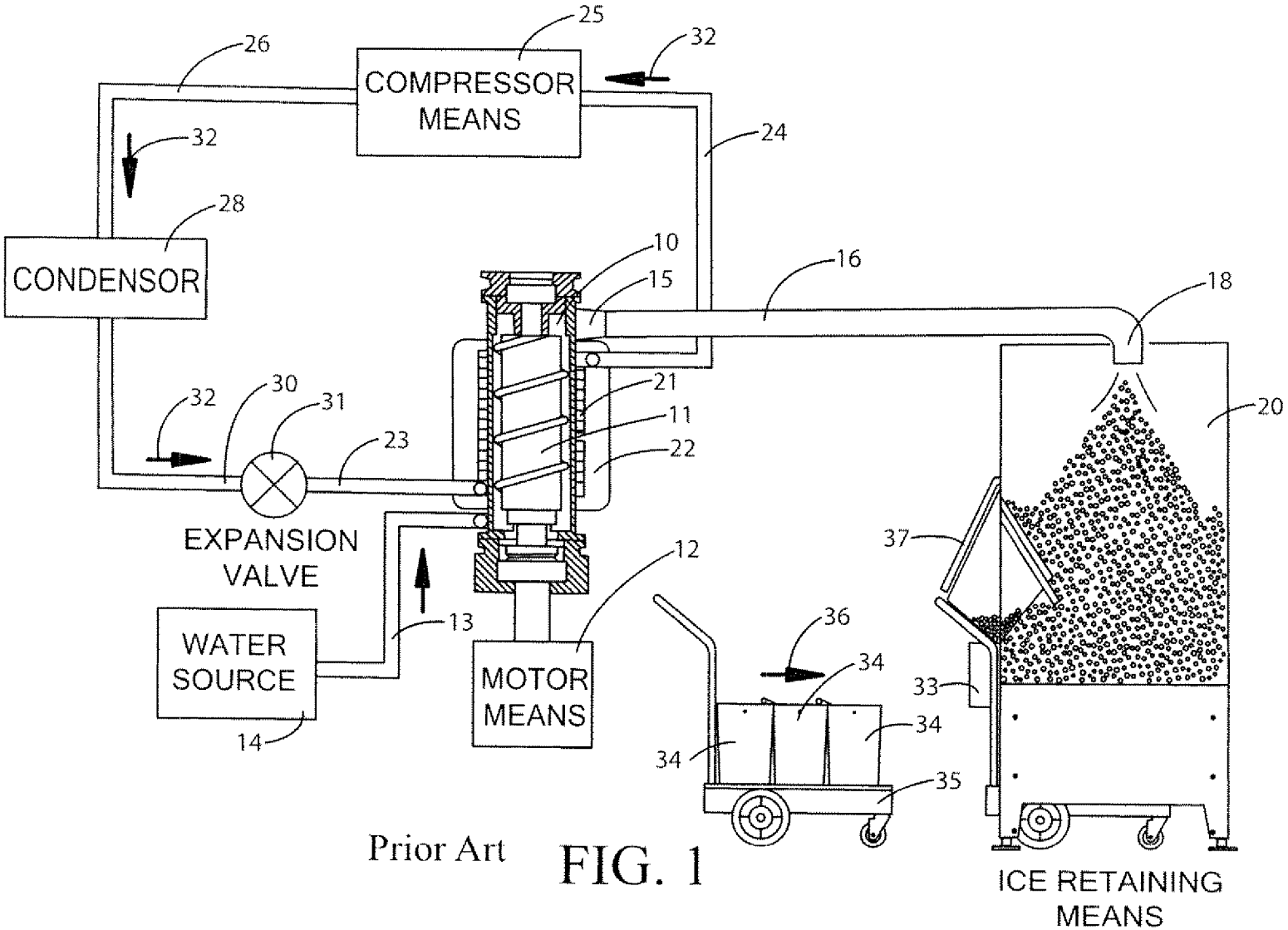

Referring now to the drawings in detail, reference is first made to FIG. 1, wherein a prior art system is shown as including a generally cylindrical ice-forming chamber 10, having an auger 11 therein adapted for rotation via a motor means 12, whereby water that is delivered into the chamber 10 via the delivery line 13, from a water source 14, is subjected to a refrigeration system that produces shavings of ice that are compressed at an upper end thereof, in an ice compression nozzle 15, to compress the ice into discrete nuggets before they enter a flexible ice delivery conduit or tube 16, for delivery of ice via a discharge end 18 thereof, into an ice retaining means 20.

The water that produces freezing inside the cylindrical chamber 10 is subjected to a conventional refrigeration cycle whereby refrigerant is delivered to a coil 21 inside a refrigerant zone 22, from a line 23 that, in turn has refrigerant that is delivered from line 24 through a compressor 25 via a line 26, to a condenser 28 via a line 30, and an expansion valve 31, as indicated by the arrow 32 forming the loop indicated in FIG. 1. The ice retaining means 20 can be as described above for U.S. Pat. No. 5,887,758, or any other means. In the particular embodiment shown in FIG. 1, the ice retaining means is in the form of an ice access and discharge system, in accordance with U.S. Pat. No. 5,887,758 having a bottom chute 33, for delivery of ice therefrom into any of a plurality of ice containers 34 mounted on a cart 35 that can be placed beneath the ice retaining means, when moved in the direction of the arrow 36, to receive ice discharged from inside the retaining means 20 via the chute 33. Alternatively, ice can be accessed from the ice retaining means 20 via a pivotally movable access door 37.

Figure 2:
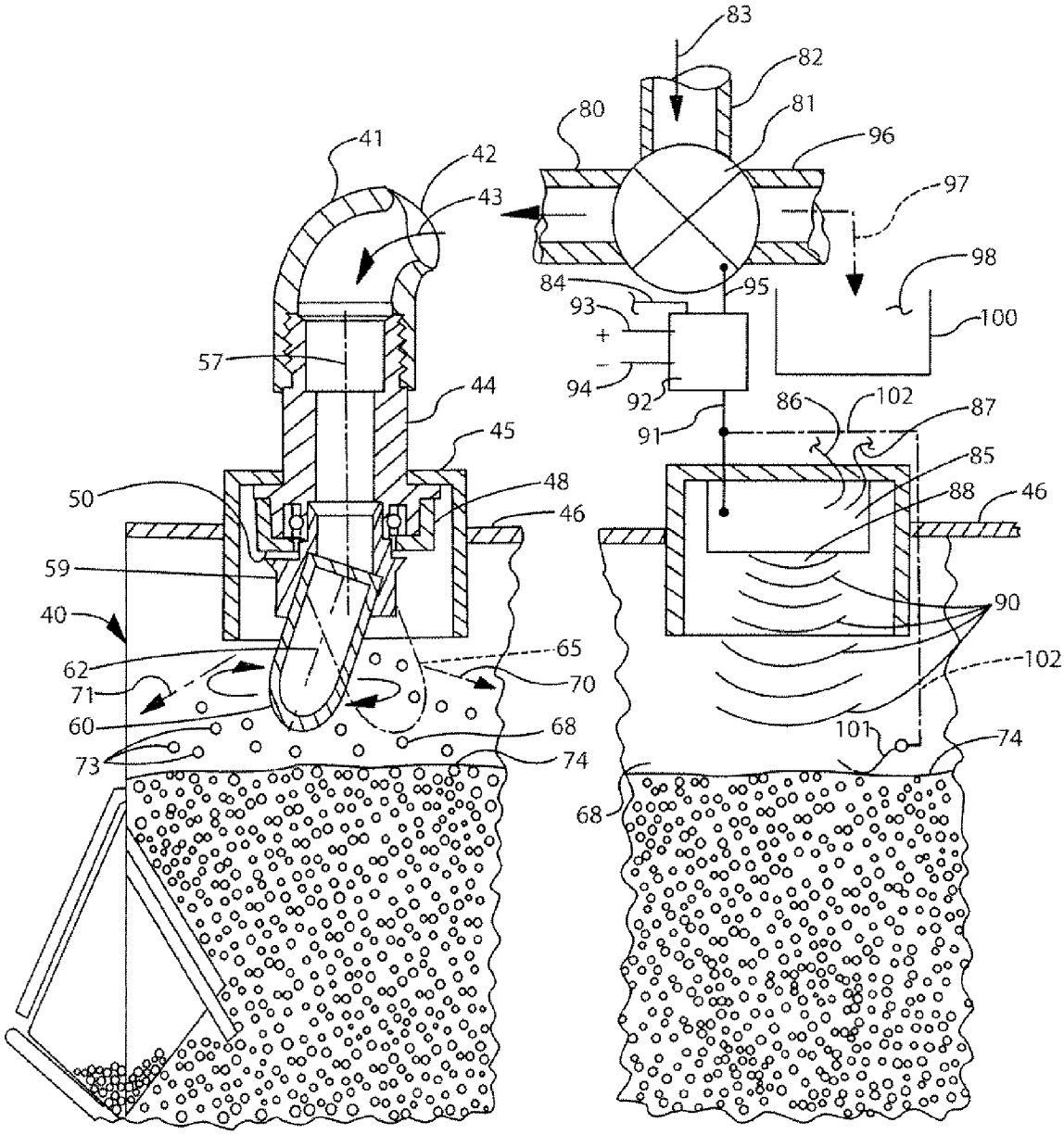

Referring now to FIG. 2, an inventive alternative to the prior art delivery of ice into a cone-shaped pile in the retaining means, is provided, in which ice can be substantially uniformally distributed across the interior of the ice retaining means 40. With respect to FIG. 2, it will be seen that an ice delivery conduit 41 is provided, for delivery of ice thereto as shown at the fragmentally illustrated end 42 thereof, in the direction of the arrow 43, with the conduit 41 being screw-threaded to an inlet conduit 44 as illustrated, with the conduit 44 being mounted via the cylindrical housing 45 through the upper wall 46 of the ice retaining unit 40, fastened by means (not shown) to the upper wall 46. Because upper walls 46 of various ice retaining means 40 can have various thicknesses, the cylindrical configuration and flange mounting for the housing 45 provides a high level of flexibility for mounting the ice distribution device on a wide variety of ice retaining means, irrespective of the thickness of their upper walls, as will be further described hereinafter, with reference to FIG. 5.

Figure 3:
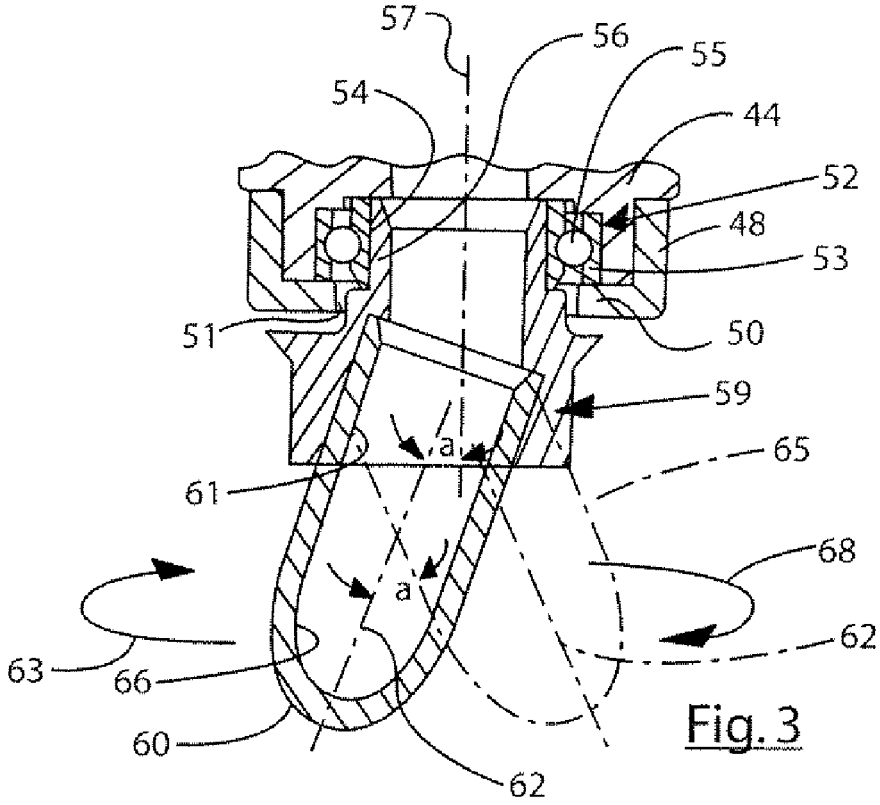
FIG. 3 is a somewhat enlarged, fragmentary illustration of the ice distribution device of FIG. 2, wherein it is illustrated that the nozzle may rotate in an eccentric manner relative to a generally vertical axis of rotation, for distribution of ice throughout a retaining unit.

The conduit 44 carries a generally cylindrical flange member 48, that, in turn, carries an end plate member 50 having an axial opening 51 therein (FIG. 3).

Sandwiched between the conduit 44 and the end plate 50, is an anti-friction roller bearing assembly 52 comprising an outer race 53, and inner race 54, and a plurality of ball bearings 55 therein.

The inner race 54 of the bearing assembly carries an upstanding sleeve 56 of a hub 59, with the hub 59 being freely rotatable relative to the outer race 53 and conduit 44 about a vertically illustrated axis 57 thereof.

An ice distribution nozzle 60 is carried in an eccentrically cut opening 61 of the hub 59, to have its angularly disposed axis 62 to be at an angle "a" relative to the axis 57, as shown in FIG. 3.

Thus, as the hub 59 rotates about the axis 57, the nozzle 60 will undergo an eccentric rotation as indicated by the arrows 63, 64, between the full line position for the nozzle 60 as shown in FIG. 3, and its phantom line position 65 therefor.

Figure 4:
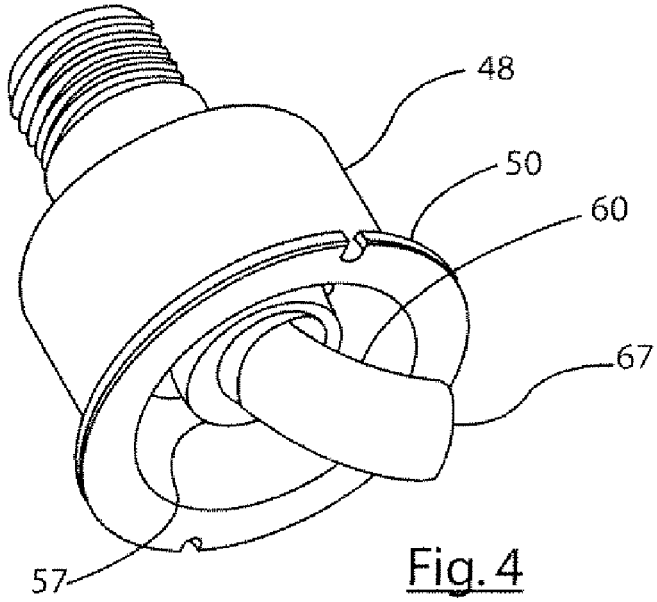
FIG. 4 is a perspective view of an ice distribution device as shown in FIG. 2.

Ice delivered via the conduit 41 and its associated conduit 44, to the nozzle 60, will thus initially be delivered axially, in line with the axis 57, but, upon reaching the interior of the nozzle 60, will engage the interior surface 66 of the nozzle 60, which, having its axis 62 disposed at an angle "a" relative to the axis 57, will apply a partial lateral force to the interior 66 of the nozzle 60, which will force a rotation of the nozzle 60 and its mounting hub 59 which carries the nozzle 60, such that the nozzle 60 will undergo an eccentric rotation as indicated by the arrows 63, 64, and the full line and phantom positions for the nozzle 60, as illustrated in FIGS. 2 and 3, such that ice nuggets or other ice particles being delivered via the nozzle 60 will be dispersed via the outlet opening 67 of the nozzle, as shown in FIG. 4, to be distributed substantially uniformally throughout the interior 68 of the ice retaining unit 40, shown in FIG. 2, in the manner shown by the arrows 70, 71 in FIG. 2. Thus, the ice nuggets 73 being delivered into the interior 68 of the ice retaining unit 40 will build up from a low level, to an ever-changing level 74, until discontinuance of ice delivery to the conduit 41, all the while with the ice nuggets or particles being substantially uniformally delivered as shown in FIG. 2.

It will be understood from the above, that the anti-friction bearing device of FIG. 3, while being illustrated as being a ball bearing unit, could be a roller bearing unit, or any other type of anti-friction device that will allow free rotation of the hub 59 which carries the nozzle 60 thereon, under the partially lateral force provided by ice being delivered through the nozzle 60, as described above.

With specific reference now to FIG. 2, it will be shown that the ice that is delivered to the delivery conduit 41, is supplied from a supply conduit 80, through a valve or diverter plate 81, that, in turn, is supplied with ice particles delivered in the direction of the arrow 83, from supply line 82.

When ice is built up to a certain predetermined level 74 in the interior 68 of the ice retaining unit 46, a sensing device of potentially various forms may recognize the buildup of ice, and control the valve or diverter plate 81, to interrupt the delivery of ice from supply line 82 to the delivery conduit 41. One manner of sensing of the same, is via an ultrasonic sensor 85 in a housing 89, suitably operated by power lines 86 and 87 in a conventional manner, such that ultrasonic waves 90 are delivered downwardly from an ultrasonic generator 88 as part of the ultrasonic device 85, to echo off the built-up level 74 of ice formed in the retaining unit 40, and, at some level, will create a signal via line 91, to activate a computer or other control unit 92, suitably electrically powered at 93, 94, to control the valve 81 via control line 95. Such activation can either operate to shut off supply of ice from supply line 82 by shutting down motor means 12 (FIG. 1) and by shutting down the refrigeration cycle of FIG. 1, both via shut down control line 84, or alternatively, can divert the supply of ice from line 82, to line 96, as shown by arrow 97, to deliver such ice to the interior 98 of an alternative ice retaining unit 100, as shown in FIG. 2.

The sensor system for sensing the level of built-up ice 84 within the retaining unit 46, can, as an alternative to the ultrasonic unit 85, be a mechanical switch or other sensor 101, activating a mechanical control line 102, that, in turn, operates the controller 92 as an alternative to the ultrasonic system 85. Even further alternatives of sensing systems, such as infrared light beams or temperature sensing devices like thermostats or the like, could alternatively be used to sense the buildup level 85 of ice in the retaining unit 40, as can other type of sensing means likewise, alternatively, be used.

Figure 5:
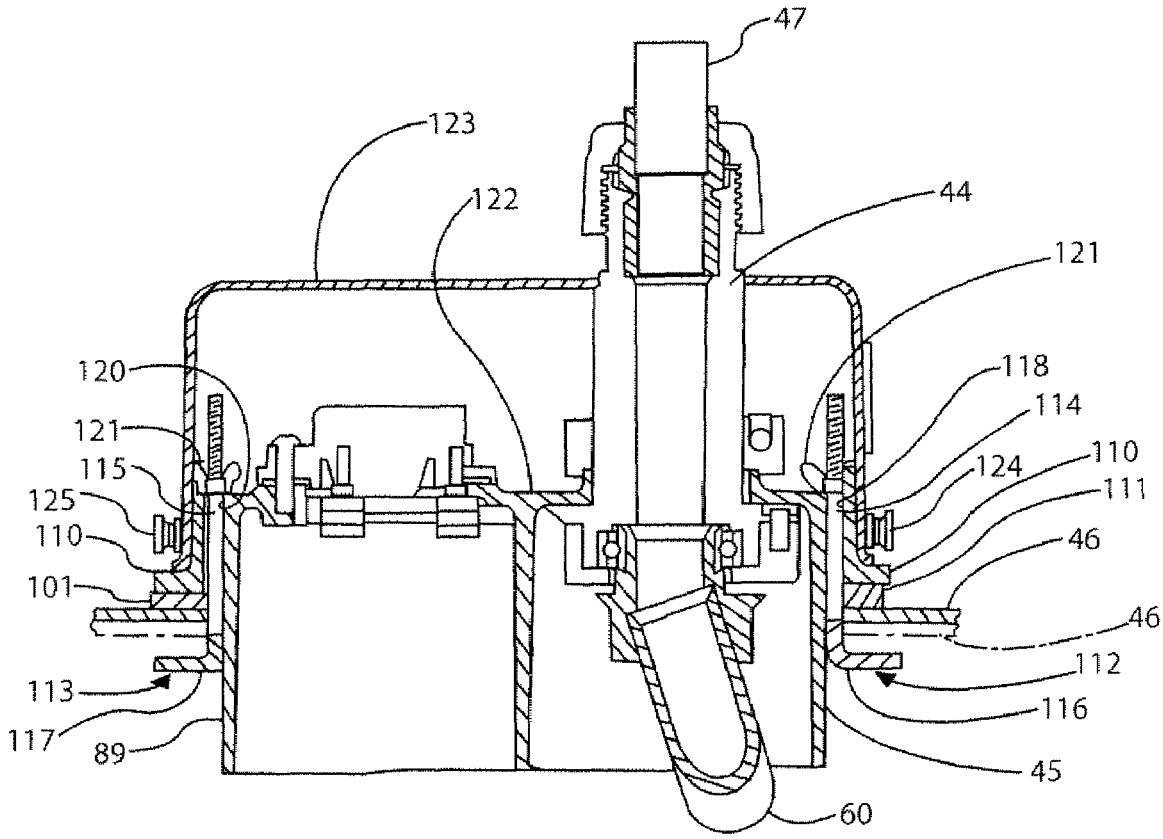
FIG. 5 is a schematic illustration of the ice distribution device and ice sensing device of FIG. 2 and their mounting on the top wall of an ice retaining unit including, the adaptability of such mounting irrespective of the thickness of the top wall of the ice retaining unit.

With reference now to FIG. 5, the mounting system for the ice distribution device, including its housing 45, and the ice build-up sensing device, including its housing 89, is illustrated. The upper wall 46 (fragmentally shown) of the ice retaining unit 40, receives the housings 45, 89 therein, which housings may be constructed as a single unit, as shown in FIG. 5, if desired, or as separate units as shown in FIG. 2. The upper wall 46 of the ice retaining unit 46 may be of the thickness shown in full lines in FIG. 5, or may have any of various thicknesses, as shown, for example, in phantom in FIG. 5.

The mounting system of the present invention is designed to accommodate ice retaining units having top or upper walls of various thicknesses.

In the embodiment shown in FIG. 5, the housings 45, 89, comprise a unitary structure, that terminates outwardly, in its rectangular periphery, with outwardly extending flange portions 110 having a gasket 111 disposed therebeneath, and carried thereby, for mounting the flange 110 against the upper surface of the upper wall 46 of the ice retaining unit 40, tightly thereagainst, and clamped to the upper wall 46 with the gasket between the flange 110 and the upper wall 46, in clamped relation therewith.

The clamping device of the present invention comprises a pair of "L," shaped rods 112, 113 having vertically disposed upper legs 114, 115, and outwardly extending legs 116, 117, respectively.

The upwardly extending legs 114 and 115 are carried in vertically disposed slots or holes 118, 120 respectively, and the upper ends of the rods 112, 113 are provided with screw threads thereon, such that nuts 121, preferably in the form of wingnuts can threadedly engage the upper ends of the rods, as the wingnuts are tightened against the upper surface 122 of the housings 45, 89, such that the outwardly extending short legs 116, 117 of the rods 112, 113, will clamp against the undersurface of the top or upper wall 46 of the ice retaining unit as the wingnuts 121 are tightened down, thereby accommodating top or tipper walls 46 that can be of various thicknesses. Other tightening means than screw threads and nuts may alternatively be used, such as, for example, spring-like clamps on the rods.

A removable cap 123 is provided, for covering the above-described mounting assembly of FIG. 5, via suitable releasable fasteners 124, 125.

It will be apparent from the foregoing that various modifications can be made in the use and operation of the device in accordance with this invention, all within the spirit and scope of the invention as defined by the appended claims.

What is claimed is:

1. An ice distribution device for delivering ice to an ice retaining unit, comprising:

(a) an ice delivery conduit for delivering ice to the ice distribution device in an axial direction;

(b) mounting means on the ice distribution device for mounting the ice distribution device relative to an ice retaining unit;

(c) an ice distribution nozzle for receiving ice delivered from said ice delivery conduit and for discharging ice through the nozzle into an ice retaining unit;

(d) said mounting means mounting said nozzle at an angle to said axial direction and for axial rotation; said mounting means including means responsive to the force of ice being delivered from said ice delivery conduit and through said nozzle, applying a sufficient partially lateral force to said nozzle to drive said nozzle in an eccentric rotation; and (e) whereby ice distributed through said nozzle can be dispersed in a fan-like array that has both axial and lateral components, for providing a substantially uniform distribution of ice in an ice retaining unit.

2. The ice distribution device of claim 1, wherein said mounting means mounting said nozzle for axial rotation includes an anti-friction bearing device.

3. The ice distribution device of claim 1, in combination with an ice retaining unit and mounted at an upper end of said ice retaining unit, for substantially uniformally distributing ice in said unit.

4. The ice distribution device of claim 3, including sensor means for sensing the level of buildup of ice distributed in the unit, and in response thereto, for activating an interrupting means for interrupting the further delivery of ice to the ice distribution device.

5. The ice distribution device of claim 4, wherein said sensor means comprises ultrasonic sensor means.

6. The ice distribution device of claim 4, wherein said sensor means comprises any one of (i) a mechanical sensor device; and (ii) a temperature sensing device.

7. The ice distribution device of claim 4, wherein said interrupting means includes means for shutting off the delivery of ice through said delivery conduit.

8. The ice distribution device of claim 4, wherein said interrupting means includes means for diverting the delivery of ice to an additional ice retaining unit.

9. The ice distribution device of claim 4, wherein said means for interrupting comprises any one of:

(i) valve means; and (ii) diverter plate means.

10. The ice distribution device of claim 5, wherein said means mounting said nozzle for axial rotation includes an anti-friction bearing device and wherein said sensor means comprises ultrasonic sensor means.

11. The ice distribution device of claim 4, wherein said interrupting means includes means for effecting any one of (a) shutting off the delivery of ice to said delivery conduit; and (b) diverting the delivery of ice to an additional ice retaining unit.

12. An ice distribution device for delivering ice to an ice retaining unit, comprising:

(a) an ice delivery conduit for delivering ice to the ice distribution device in an axial direction;

(b) mounting means on the ice distribution device for mounting the ice distribution device relative to an ice retaining unit;

(c) an ice distribution nozzle for receiving ice delivered from said ice delivers conduit and for discharging ice through the nozzle into an ice retaining unit;

(d) said mounting means mounting said nozzle at an angle to said axial direction and for axial rotation; said mounting means including means responsive to the force of ice being delivered from said ice delivery conduit and through said nozzle, applying a sufficient partially lateral force to said nozzle to drive said nozzle in an eccentric rotation; and e) whereby ice distributed through said nozzle can be dispersed in a fan-like array that has both axial and lateral components, for providing a substantially uniform distribution of ice in an ice retaining unit, in combination with an ice retaining unit and mounted at an upper end of said ice retaining unit, for substantially uniformally distributing ice in said unit, wherein the mounting means of clause (b) includes at least one housing for disposition on an upper wall of an ice retaining unit, with a generally peripheral flange carried by said housing and at least one clamping rod carried by said housing; with said at least one clamping rod having a lower portion adapted to engage inside an upper wall of an ice retaining unit and clamping thereagainst, and with tightening means carried by said at least one clamping rod for moving the at least one clamping rod relative to the housing with the lower portion of the clamping rod against the inside of an upper wall of the ice retaining unit, for tightening the generally peripheral flange of the at least one housing against the upper wall of the ice retaining unit, irrespective of the thickness of the upper wall of the ice retaining unit.

13. The ice distribution device of claim 12, wherein there are at least two said clamping rods and associated said tightening means.

14. An ice distribution device for delivering ice to an ice retaining unit, comprising:

(a) an ice delivery conduit for delivering ice to the ice distribution device;

(b) mounting means on the ice distribution device for mounting the ice distribution device relative to an ice retaining unit;

(c) an ice distribution nozzle for receiving ice delivered from said ice delivery conduit and for discharging ice through the nozzle into an ice retaining unit; and (d) wherein the mounting means of clause (b) includes at least one housing for disposition on an upper wall of an ice retaining unit, With a generally peripheral flange carried by said housing and at least one clamping rod carried by said housing; with said at least one clamping rod having a lower portion adapted to engage inside an upper wall of an ice retaining unit and clamping thereagainst, and with tightening means carried by said at least one clamping rod for moving the at least one clamping rod relative to the housing with the lower portion of the clamping rod against the inside of an upper wall of the ice retaining unit, for tightening the generally peripheral flange of the at least one housing against the upper wall of the ice retaining unit, irrespective of the thickness of the upper wall of the ice retaining unit.

15. The ice distribution device of claim 14, wherein there are at least two said clamping rods and associated said tightening means.

16. The ice distribution device of claim 1, wherein said mounting means includes anti-friction means carrying said nozzle for freely rotatable motion about a generally vertical axis.

* * * * *